United States Patent [19]

Blight et al.

[11] Patent Number: 4,904,965

[45] Date of Patent: Feb. 27, 1990

[54] MINIATURE CIRCULATOR FOR MONOLITHIC MICROWAVE INTEGRATED CIRCUITS

[75] Inventors: Ronald F. Blight, Framingham; Robert L. Mozzi, Lincoln; Ernst F. R. A. Schloemann, Weston, all of Mass.

[73] Assignee: Raytheon Company, Lexington, Mass.

[21] Appl. No.: 289,879

[22] Filed: Dec. 27, 1988

[51] Int. Cl.[4] ..... H01P 1/383

[52] U.S. Cl. ..... 333/1.1; 333/24.2

[58] Field of Search ..... 333/1.1, 24.2, 24.1

[56] References Cited

U.S. PATENT DOCUMENTS

| | | | |
|---|---|---|---|
| 3,467,918 | 9/1969 | Dunn et al. | 333/1.1 |
| 3,522,555 | 8/1970 | Hashimoto et al. | 333/1.1 |
| 3,789,324 | 1/1974 | Iwase et al. | 333/1.1 |
| 3,836,874 | 9/1974 | Maeda et la. | 333/1.1 |

FOREIGN PATENT DOCUMENTS

| | | | |
|---|---|---|---|
| 39610 | 4/1981 | Japan | 333/1.1 |

OTHER PUBLICATIONS

Knerr, R. H. et al., "A Compact Broad-Band Thin--Film Lumped-Element L-Band Circulator", IEEE Transactions on Microwave Theory and Techniques, Dec. 1970, pp. 1100-1107.

Knerr, R. H., "A 4-GHz Lumped-Element Circulator", IEEE Transactions on Microwave Theory and Techniques, Mar. 1973, pp. 150-151.

Knerr, R. H., "An Annotated Bibliography of Microwave Circulators and Isolators: 1968-1975", IEEE Transactions on Microwave Theory and Techniques, vol. MTT-23, No. 10, Oct. 1975, pp. 818-825.

Ogasawara, N. et al., "Coplanar-Guide and Slot-Guide Junction Circulator", Electronics Letters, May 6th 1971, vol. 7, No. 9, pp. 220-221.

*Primary Examiner*—Paul Gensler

*Attorney, Agent, or Firm*—Denis G. Maloney; Richard M. Sharkansky

[57] ABSTRACT

A miniature circulator which is microwave integrated circuit compatible and based on microstrip transmission techniques is described. The circulator includes a dielectric or semiconductor substrate having microstrip transmission lines formed thereon and a patterned metalization formed as the node metalization for the circulator. The substrate may carry other circuits such as power combiners, amplifiers, and switches. The substrate further includes monolithic capacitors over the substrate at the center of the circulator in a first embodiment or disposed along the periphery of the patterned metalization in the second embodiment. The capacitors are used to capacitively couple the patterned metalization or node metalization to the ground plane conductor. The value of capacitance is selected to provide value broadband performance. A ferrite disc, preferably hexagonal in shape, is disposed over the substrate and has disposed thereon a coupling structure, preferably an interwoven coupling structure comprised of two layers of metalization separated by an intermediate layer of insulating material. Preferred techniques for providing said coupling structure are described.

15 Claims, 11 Drawing Sheets

MINIATURE CIRCULATOR FOR MONOLITHIC MICROWAVE INTEGRATED CIRCUITS

BACKGROUND OF THE INVENTION

This invention relates generally to non-reciprocal devices and more particularly to miniature microwave circulators and isolators.

As is known in the art, so-called microwave monolithic integrated circuits include active and passive devices which are formed using semiconductor integration circuit techniques to provide various types of microwave circuits. One such particular application of this technology is in so-called transmit/receive modules (transceiver modules) for use in phased array antennas. In transceiver modules active devices such as field effect transistors are combined with passive devices such as capacitors, resistors, inductive elements, and the like to form various microwave functions such as amplifiers and switches. It is desirable in transceiver modules to have one or more elements which can act as circulators and thus can be used to steer electromagnetic energy through the transceiver module.

Although non-reciprocal microwave components such as circulators and isolators have been known for many years, no convenient approach is available for combining the circulator on a common substrate which supports the integrated circuits. Generally, these non-reciprocal components are fabricated separately on different substrates than the semiconductor components or the transceiver module. The non-reciprocal component such as the circulator are fabricated either on a ferrite substrate or on a dielectric substrate that has a ferrite insert. Both methods of fabrication have a disadvantage of requiring relatively long connecting transmission lines between integrated circuits and the circulator with the attendant transmission line loss. This hybrid-type of approach is also relatively labor intensive and, therefore, costly.

Circulators which are intended for use with microwave integrated circuits are usually designed for coupling by means of microstrip transmission lines. An example of a circulator known in the art is a microstrip circulator formed on a ferrite substrate by patterning a top surface metal plane. The metal pattern comprises a circular section, described as the junction resonator and three radial line sections emerging at equally spaced points on the resonator's circumference. These lines are of designed width and length and serve to impedance match the junction to a desired level at the circulator's microstrip terminals.

Another example of a circulator which is well known in the art includes a dielectric substrate having a ground plane conductor disposed over a first surface thereof and a ferrite inserted within a hole provided in the dielectric substrate. In this particular design, strip conductors of microstrip transmission lines are connected to a central metal disc that is approximately the same diameter as the ferrite disc. Critical design parameters for this type of circulator are the radius of the metal disc (R) and the coupling angle which is defined as half the angle subtended by each microstrip at the perimeter of the central disc. Circulator design of the type described above have been demonstrated to have the capacity for very large bandwidths.

Another type of circulator which is also well known in the art and is also based on a microstrip transmission medium uses a ferrite member having coupling structure fabricated on the surface of the ferrite disc. As reported by R. H. Knerr, et al. IEEE Transactions, MTT-18, page 1100–1108, December 1970, three mask levels were required to fabricate the coupling structure by photolithographic techniques. Two mask levels were required for the metalization, and one mask level was required for the dielectric layer which separates the layers of metalization. This circulator design achieves a significant size reduction compared to the aforementioned microstrip circulator approaches.

If one were to adapt this latter approach to monolithic integrated circuits based upon prior techniques, one would have to drill a hole in a dielectric or semiconductor substrate and insert the member with the interwoven coupling structure into the hole.

Each of the microstrip designs described above requires a hole to be drilled into the dielectric substrate to receive the ferrite disc. This requirement presents severe manufacturing limitations when the circulators are fabricated on brittle substrates such as gallium arsenide, particularly when the intent is to integrate the circuit with monolithic microwave integrated circuits provided on the gallium arsenide substrate. Accordingly, the requirement of a hole in these types of circulators makes such circulators generally not suitable for integration with semiconductor elements on brittle substrates like gallium arsenide.

Other problems with each of the above approaches include the difficulty of fabricating the circular ferrite member, particularly when the ferrite member carries or supports an interwoven coupling structure.

These fabrication difficulties can be avoided by using a substrate without a hole and placing the ferrite disc with a coupling structure on top of the substrate, and thus otherwise retaining structure as described above. The problem with this approach is that this technique does not lead to circulators with useful performance, since the electromagnetic field does not penetrate sufficiently into the ferrite but rather remains concentrated in the dielectric substrate.

Accordingly, it would be desirable to provide a circulator and other magnetic non-reciprocal devices which can be readily integrated with monolithic microwave integrated circuits, and further which are relatively easy to fabricate, but which provide circulators having useful practical performance.

SUMMARY OF THE INVENTION

One approach for providing a non-reciprocal device such as a circulator which is compatible with monolithic microwave integrated circuits is described in our copending application entitled "Improved Miniature Circulators for Monolithic Microwave Integrated Circuits" filed Dec. 27, 1988, Ser. No. 289,895 and assigned to the assignee of the present invention. In this application, a circulator which uses coplanar waveguide transmission lines as the transmission line medium is described. The circulator includes a ferrite body which is disposed over a dielectric substrate. The technique describes a non-reciprocal component such as a circulator which is compatible with or suitable for use in monolithic microwave integrated circuits. The device is compatible because it eliminates the necessity for drilling a hole or a recess into the semiconductor substrate to receive the ferrite insert as described above. A circulator based upon microstrip transmission medium would be more easily integrated with most monolithic microwave integrated circuits, since microstrip is the preferred transmission medium for most of such circuits.

In accordance with the present invention, a circulator which is suitable for integration with monolithic microwave integrated circuits and which is based on microstrip transmission line techniques includes a dielectric substrate having disposed over a first surface thereof a ground plane conductor. Disposed over a second opposite surface of said dielectric substrates is a patterned conductive layer and disposed over said patterned conductive layer is a disc comprised of a ferrimagnetic material. A coupling structure is then disposed over said disc and includes at least two strip conductors spaced by a dielectric having first ends of such strip conductors providing terminals of the circulator and second ends of said strip conductors connected to said patterned metal layer disposed on the second surface of said substrate. A monolithic capacitor is provided between the patterned metal layer and the ground plane conductor to capacitively couple the patterned metal layer to the ground plane conductor. With this particular arrangement, by providing the monolithic capacitance between the patterned metal layer and the ground plane conductor, the electromagnetic field is not concentrated in the dielectric substrate. Thus, this approach provides a circulator having useful performance without the necessity of drilling a hole through the substrate to accept a ferrite insert.

In accordance with a further aspect of the present invention, a circulator which is suitable for integration with monolithic microwave integrated circuits includes a substrate having disposed over a first surface thereof a ground plane conductor and disposed over a second surface thereof a monolithic, controlled node to ground capacitor. The capacitor includes a first conductive layer disposed on said second surface, a dielectric layer disposed over said first surface, and a second layer disposed over said dielectric layer patterned to provide a node metalization for the circulator. The first conductive layer of said capacitor is directly coupled to the ground plane conductor through a conductively filled via hole provided through the dielectric substrate. The circulator further comprises a ferrite disc having a substantially hexagonal shape disposed on said node metalization, with said ferrite disc carrying a coupling structure comprised of at least a pair of strip conductors, each strip conductor having a pair of branched strip conductor portions coupled between a pair of beam leaded strip conductor portions. A first one of the beam leads of each strip conductor provides connections to microstrip transmission lines formed on said substrate and a second one of the beam leads of each strip conductor is connected to the node metalization. Each strip conductor portion of each one of the strip conductors is interlaced with the strip conductor portions of each one of the other strip conductors to provide a balanced, interwoven coupling structure for the circulator With this particular arrangement, by providing the monolithic, controlled node to ground capacitance between the node metalization and the ground plane conductor, the problems encountered with the electromagnetic field being concentrated in the substrate are eliminated by directly coupling the controlled, node to ground capacitor to the ground plane conductor by the plated via hole. Further, the controlled node to ground capacitor permits selection of the capacitance value thereof to provide optimum performance for such a circulator. This approach provides a circulator having a ferrite disposed over the substrate, thus eliminating the need for a hole in the substrate. A further advantage with the approach is that a ferrite disc having a hexagonal shape is relatively simple to fabricate when compared to a circular ferrite member. The hexagonally shape ferrite is easily fabricated by sawing techniques. A ferrite substrate having many pattern hexagons may be easily cut into many of such hexagonally shaped members.

In accordance with a still further aspect of the present invention, a method for providing an interlaced coupling structure disposed over a disc comprised of a ferrimagnetic material is provided. A plurality of patches of spaced masking material are provided over a substrate. The substrate may be either a ferrite in which case the coupling structure will be fabricated directly on the ferrite member, or alternatively the substrate may be any suitable temporary support in which case the coupling structure will be fabricated separately from the ferrite disc and is mated to the disc in a subsequent step. Disposed over said patches of spaced masking material and over said substrate are a plurality of patterned pairs of strip conductor segments. Each pair of strip conductor segments has a first relatively long leg portion and a second relatively short leg portion each having a common terminus at a wide strip conductor portion disposed over the spaced patches of masking material. The relatively long leg portion of a first one of said pairs of strip conductor segments is disposed opposite a relatively short leg portion of a corresponding one of said pairs of strip conductor segments. A dielectric layer is provided over said patterned pairs of strip conductor segments. The dielectric is patterned to provide a plurality of apertures to expose end portions of each of long branches of each one of said pairs of strip conductor segments. A second patterned layer which is the inverse pattern of the first patterned layer is disposed over said dielectric. The second patterned layer is provided such that the long branches of the second patterned layer are disposed in alignment with underlying short branches of the first patterned layer and with the long branches of the second patterned layer being connected to the long branches of the first patterned layer through the apertures provided in the dielectric layer. With this particular arrangement, an interlaced coupling structure having six interconnects through the dielectric, to interconnect the upper layer metalization and lower layer metalization is provided. Thus, the fabrication techniques for such a coupling structure are simplified over prior techniques.

In one embodiment, the substrate is comprised of ferrite material and after the photoresist is removed from the underlying relatively wide strip conductor portions, the relatively wide strip conductor portions are folded up and over the second metalization layer, and the substrate is then cut by a series of six cuts into a hexagonal shape. Alternatively, the relatively labor intensive step of folding the beam lead up may be eliminated by cutting the ferrite disc from the backside (the side opposite the one over which the coupling structure is provided) using a wafer cutting saw with an accurately controlled depth of cut and well defined alignment marks referenced to an edge of the substrate and disposed on the backside of the wafer. With this particular arrangement, many circulator elements each having a hexagonal shaped and an interlaced coupling structure thereover as provided. The circulator elements may then be mounted on a substrate which carries monolithic microwave integrated circuits and is thus readily integratable with microwave monolithic integrated circuits.

Alternatively, the substrate over which the patterned strip conductors are provided is comprised of a material which is easily dissolved away. Thus, after the second patterned layer is formed over the substrate, the substrate is dissolved leaving an interlaced coupling structure supported by the dielectric layer. With this particular arrangement, a circular-shaped ferrite disc or a hexagonally shaped ferrite disc may be provided on a suitable substrate and thus integrated with monolithic microwave integrated circuits formed thereon. The coupling structure, since it is fabricated as a separate component of the circulator, is disposed over and bonded to the ferrite substrate. This method of fabrication is advantageous particularly when the cost of the ferrite material is relatively high as for single crystal ferrite material, because if the coupling structure is fabricated separately from the hexagonal disc of ferrite, virtually none of the ferrite material need be wasted. In this instance, the ferrite substrate may be patterned with very closely spaced or packed "hexagon-shaped" ferrite discs. No waste is provided because the coupling structure is not present on the ferrite substrate. In the other techniques, the coupling structure prevents closely spacing of the hexagonally shaped discs.

BRIEF DESCRIPTION OF THE DRAWINGS

The foregoing features of this invention, as well as the invention itself, may be more fully understood from the following detailed description of the drawings, in which:

FIGS. 9A–12A are a series of plan views showing steps in the fabrication of an interwoven, beam leaded coupling structure having a reduced number of interconnects between upper and lower metalization;

FIGS. 9B–12B are a series of cross-sectional views taken along lines **9*b*—9*b* of FIG. 9A through 12*b*—12*b* of FIG. 12A** respectively;

FIGS. 14A—16A are a series of plan views showing steps in the fabrication of a coupling structure having patches of dielectric disposed under conductor cross overs;

FIGS. 14B–16B are a series of cross-sectional views taken along lines **14*b*—14*b* through 16*b*—16*b* of FIGS. 14A–16A respectively.

DESCRIPTION OF THE PREFERRED EMBODIMENTS

Figure 1:
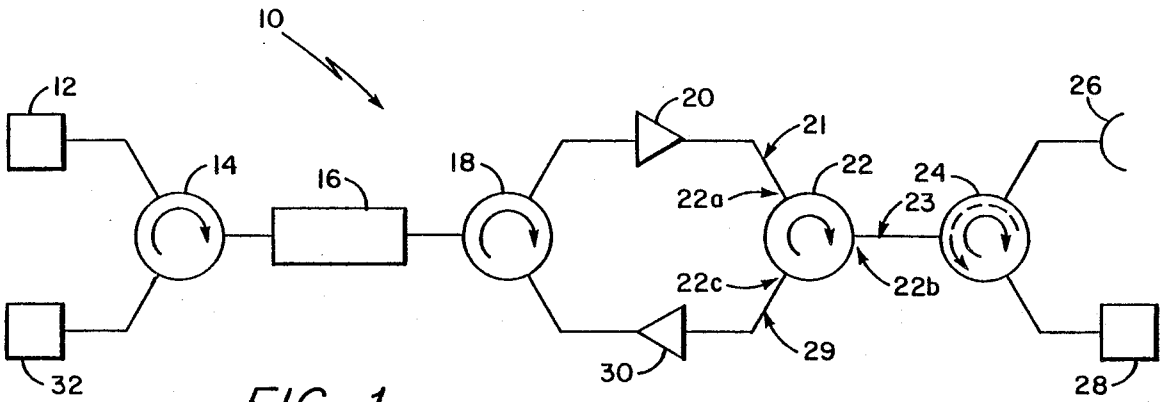
FIGS. 1 and 1A are block diagrams of transmit/-receive modules each having at least one circulator fabricated in accordance with the present invention.

Referring now to FIG. 1, a transmit receive module 10 is shown to include an exciter 12 which is coupled to a circulator 14 at a first port, with a second port of circulator 14 being coupled to a reciprocal phase shifter 16. The other end of the reciprocal phase shifter 16 is coupled to a first port of a second circulator 18, which has a second port connected to a high power amplifier 20 used to provide an amplified replicated signal from the exciter 12 during a transmit mode. The output of high power amplifier 20 is connected to a first port **22*a* of a third circulator 22. A second port 22*b* of circulator 22 is connected to a first port of a fourth circulator here a switchable circulator 24 having a second port connected to a radiating element 26 and having a third port connected to a matched load 28**.

A low noise amplifier 30 is disposed between the third port **22*c* of circulator 22 and the third port of circulator 18 as also shown. A low noise amplifier 30 provides an amplified version of a signal received by the antenna 26 during a receive mode of operation. A receiver 32 used to process a received signal is shown connected to a third port of circulator 14. Each circuit element is interconnected via microstrip transmission lines. Here microstrip transmission lines 21, 23, and 29 which interconnect circulator 22** to other circuit elements are particularly denoted.

As shown in FIG. 1, the transmit receive module uses four circulators, one of which is switchable. In a transmit mode, the function of the circulator is to channel the signal from the exciter through the phase shifter and to the high power amplifier and to the radiating element and to dump any power reflected from the radiating element into the load. In the receive mode, where the sense of circulation is given by the broken line in the ferrite switch of FIG. 1, the signal travels from the antenna through the low noise amplifier 30, to the phase shifter 16 and to the receiver 32. Not all of the circulators shown on FIG. 1, however, are required. The circulators on either side of the phase shifter, as well as, the ferrite switch shown in FIG. 1 can be replaced by semiconductor switches. Since semiconductor switches are generally smaller than circulators, their use in integrated circuits is preferred provided that the switches and the circulators can serve the same function and also provided that the power handling capability of the semiconductor switches is adequate. The remaining circulator 22 cannot easily be replaced by a semiconductor switch, since it is required to isolate the final stage of the high power amplifier from the radiating element at the antenna face. If circulator 22 was also replaced by semiconductor switch, a significant fraction of the transmitted power may be reflected back into the high power amplifier 20 reducing the efficiency of the amplifier, as well as providing other undesirable effects. Even if reflections from the array could be completely eliminated at a particular steering angle of the array, reflected energy would still be present at other steering angles. Accordingly, a load isolation device such as the circulator 22 is generally preferred in active transmit/-receive modules.

Figure 1A:
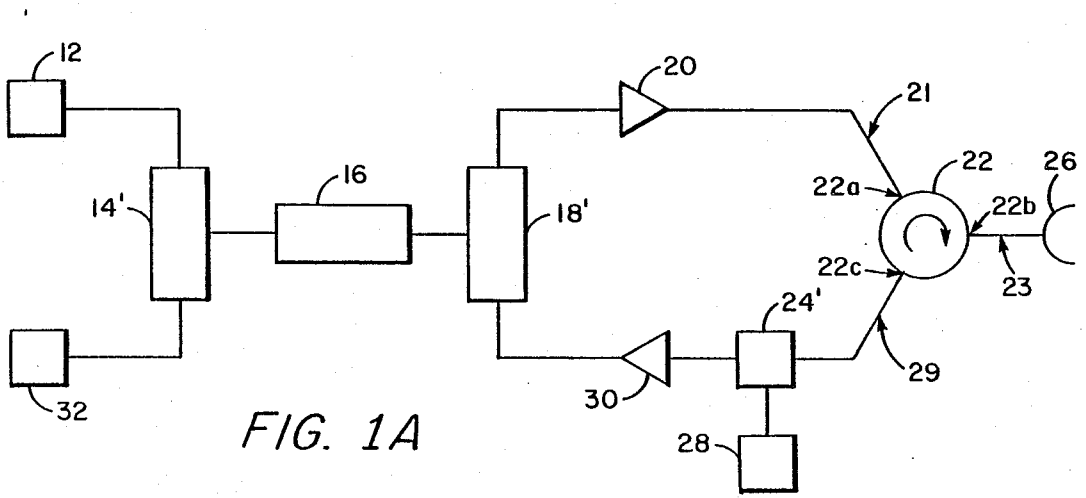

A modified version of the transmit receive module as generally described above in conjunction with FIG. 1 is shown in FIG. 1A. FIG. 1A shows the exciter 12 connected to a first branch port of a transmit/receive switch 14' which has a common port connected to phase shifter 16 and a second branch port connected to receiver 32. The other end of the phase shifter 16 is connected to a common port of a transmit receive switch 18' having a first branch port connected to the high power amplifier 20 and a second branch port connected to low noise amplifier 30. The output of the high power amplifier 20 is connected to the first port **22*a* of circulator 22 as described above. The second port 22*b* of the circulator 22 is here connected directly to the radiating element 26, and the third port 22*c* of the circulator 22 is connected to a common port of a third TR switch 24'. A first one of the branch ports of switch 24' is connected to a match load 28 and a second branch port of the switch 24' is connected to the input of the low noise amplifier 30. In this particular arrangement, during the transmit phase, the circulator 22 will sufficiently isolate the output of the high power amplifier 20 from reflections which occur at the antenna face 26, when the switch 24' couples the third port of circulator 22 to the matched load 28. During a receive mode, the switch 24' is used to connect the third port of circulator 22 to the input of the low noise amplifier 30**.

Fabrication of the phase shifter, amplifiers and switches is generally a relatively straight forward task given the current level of the state of the art in monolithic microwave integrated circuits. These devices often are fabricated on a common substrate and are generally connected together by microstrip transmission lines. It would be desirable to fabricate the circulator 22 on the same substrate which carries the amplifiers, the phase shifter, the switches, and microstrip transmission lines. Circulators that are easily integrated with such circuits will now be described in conjunction with FIGS. 2–17.

Figure 2:
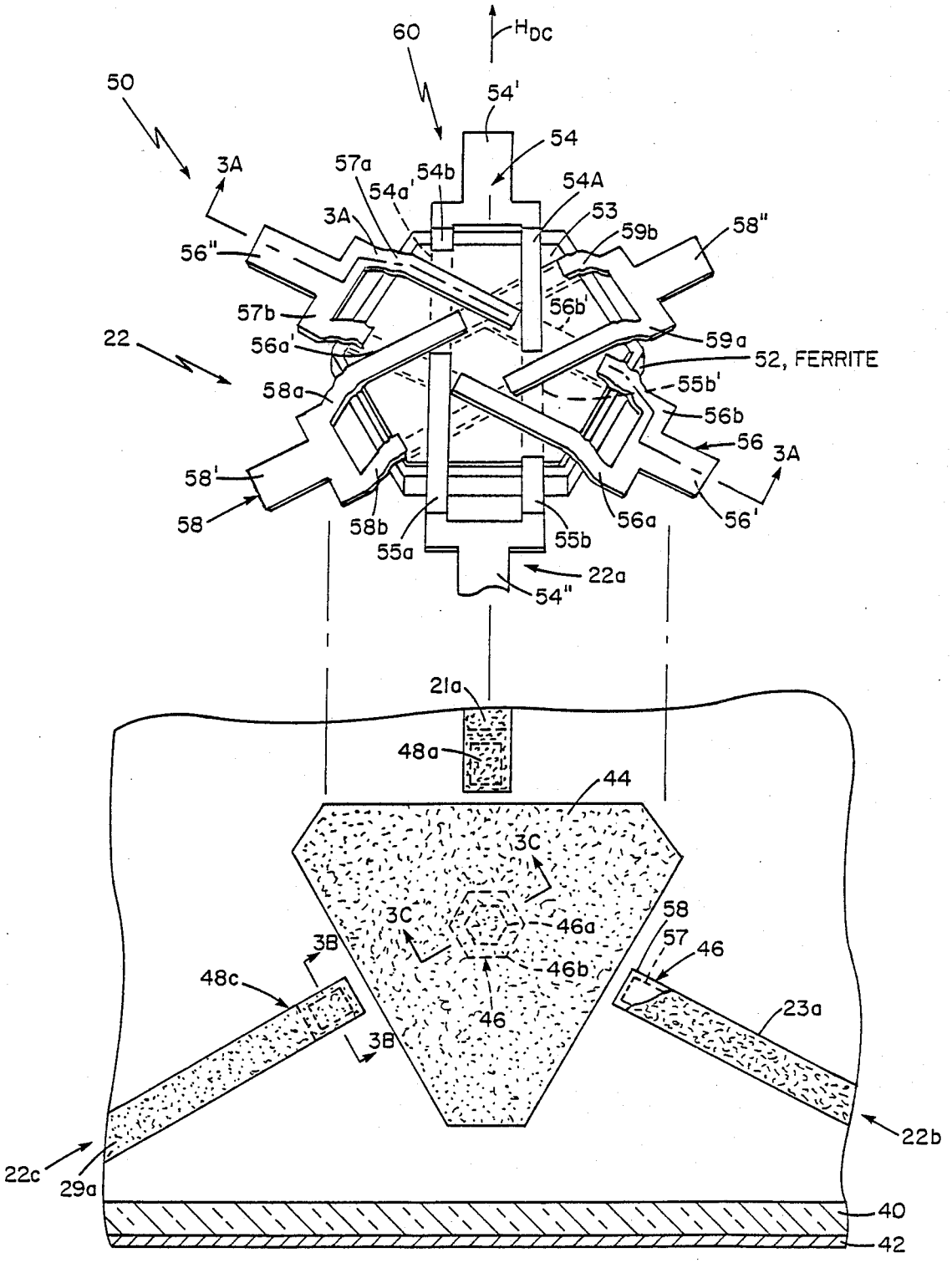
FIG. 2 is an exploded perspective view of a circulator in accordance with a first aspect of the present invention.
Figure 2A:
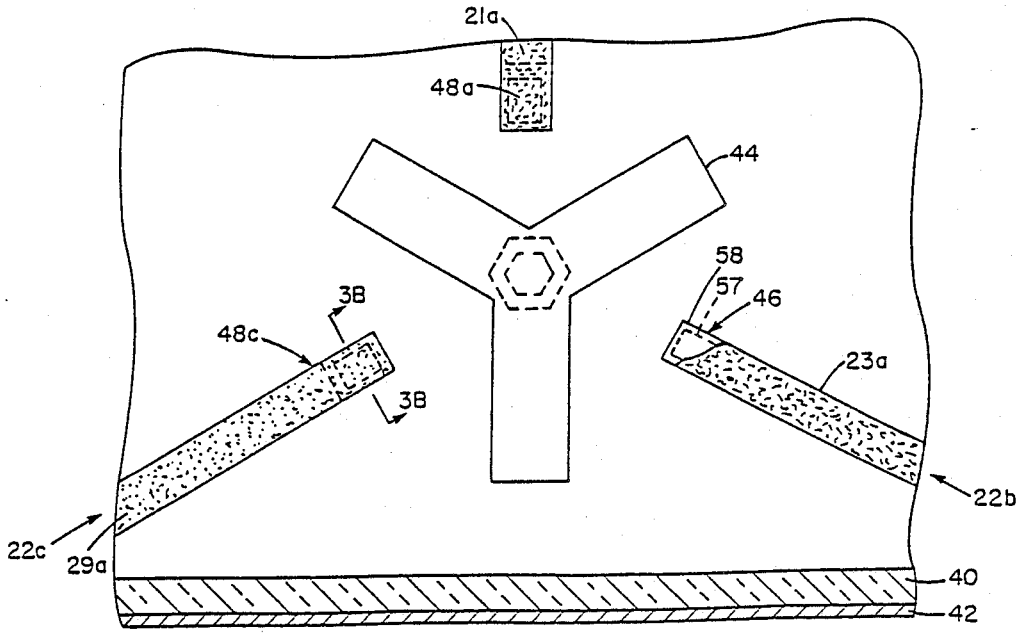
FIG. 2A is a plan view of an alternative arrangement for a node metalization for the circulator of FIG. 2.

Referring now to FIG. 2, a circulator 50 which may be used to provide circulator 22, as described, in conjunction with FIGS. 1 and 1A, for example, is shown to include a substrate 40 which here may also carry (but not shown in FIG. 2) the high power amplifier 20, the low noise amplifier 30, switches 14', 18' and 24' matched load 28, and phase shifter 16 as is generally known. Here substrate 40 is comprised of a semiconductor material such as gallium arsenide. Alternatively, dielectric materials such as aluminum oxide may be used to provide the circulator element which would then be coupled in a hybrid manner to circuits which carry the other remaining elements mentioned above. Here the gallium arsenide substrate 40 has a ground plane conductor 42 comprised of gold disposed on a first surface thereof. Disposed on a second, opposite surface thereof are patterned strip conductors **21*a*, 23*a*, and 29*a* which form in combination with the dielectric of the substrate 40 and the underlying ground plane 42, microstrip transmission lines 21, 23, and 29 (FIG. 1, 1A). Monolithic capacitors 48*a*–48*c* capacitively couple end portions of said transmission lines to the ground plane conductor 42. Also disposed over the second surface of substrate 40 is a node metalization 44 here having the shape of a truncated triangle, although other shapes such as a 3 pointed star 44' as shown in FIG. 2A may alternatively be used. The function of the node metalization 44 is to electrically connect the grounded portions of the coupling structure together. The node metalization 44 is capacitively coupled to the ground plane conductor 42 by a monolithic node capacitor 46. The circulator 22 further includes a circulator element 50 comprised of a coupling structure 60 which is disposed over a ferrite member 52. Here ferrite member 52 is a ferrite disc having a hexagonal shape as shown. Preferred ferrite material include lithium ferrites and garnets such as YIG. The ferrite 52** is biased by a magnetic field $H_{DC}$ from a magnet (not shown).

Figure 3A:
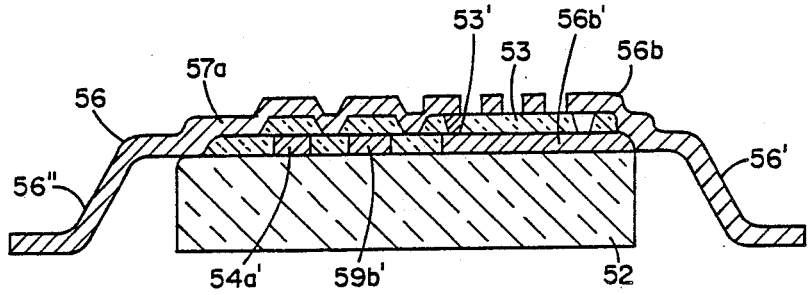
FIGS. 3A, 3B, 3C are a series of cross-sectional views taken along lines 3A—3A, 3B—3B, and 3C—3C of FIG. 2.

Fabrication of the circulator member 50 will be described in conjunction with FIGS. 9A–12A and 14A–16A. Suffice it here to say, however, that the circulator member 50 includes the aforementioned ferrite disc 52 here having a hexagonal shape with the coupling structure 60 disposed over a first surface thereof. Coupling structure 60 includes here three branched strip conductors 54, 56, and 58, with each one of the strip conductors 54, 56, and 58 having first and second relatively wide common strip conductor portions 54'–58' and 54''–58'' respectively connected together, via relatively narrow, interlaced strip conductor portions **55*a*–55*b*; 57*a*–57*b*; and 59*a*–59*b*. Referring also to FIG. 3A, as an exemplary one here strip conductor 56 has a first set of portions (FIG. 2) 56*b'* disposed on the ferrite hexagonal disc 52 with said first portion 56*a'* being spaced from interlaced portions of conductors 54 and 58 by the dielectric layer 53. A second set of portions 56*a* (FIG. 2), 56*b* and 57*a*, 57 *b* (FIG. 2) are disposed over the dielectric layer 53 as shown, and connected via underlying conductors 56*a'* (FIG. 2) and 56*b'* through apertures 53' provided in the dielectric layer 53. Upper portions 56*a* (FIG. 2) and 56*b* have a common terminus at a first relatively wide strip conductor portion 56' and upper portions 57*a* and 57*b* (FIG. 2) are also terminated here at second relatively wide strip conductor portion 56''. Portion 56' forms the signal terminal for the circulator and portion 56'' is used to terminate conductor 56 at the node metalization 44 (FIG. 2**).

Figure 3B:
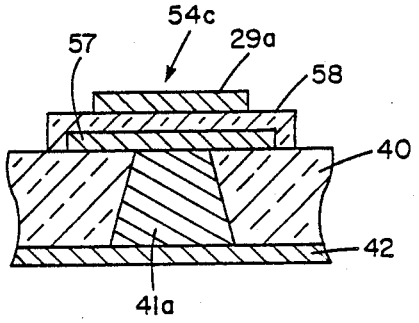
Figure 3C:
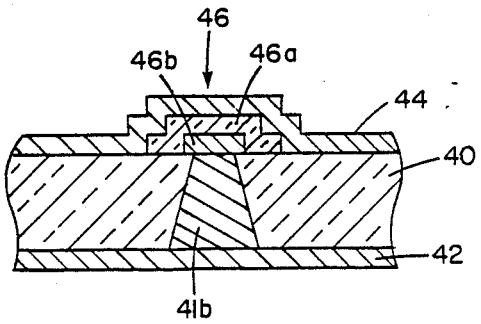

Referring now to FIGS. 3B and 3C, the details of construction of the monolithic integrated capacitors as described in conjunction with FIG. 2 are shown. Referring to FIG. 3B in particular, capacitor **48*c*, which is similar in construction to the other capacitors 48*a* and 48*b* (FIG. 2) is shown to include a thin conductive layer 57 which is disposed over substrate 40 and connected to the ground plane 42 by a via hole 41*a* as shown. Disposed over the thin conductive layer 57 is a layer of dielectric 58 here of silicon oxide, silicon nitride, or polyimide or other suitable dielectric which here completely covers the underlying conductive layer 57. A layer 29*a* which here is the patterned strip conductor portion for the microstrip transmission line 29 (FIG. 1, 1A) is disposed over the dielectric layer 58. The thickness of the dielectric layer 58, as well as, the width and length of strip conductor portion 29a are chosen to provide a predetermined capacitance between microstrip transmission line 29 and the ground plane conductor 42, as will be described hereinafter. As also shown in FIG. 3C, the central node capacitor 46 here has a hexagonally shaped first conductive layer 46b disposed over substrate 40 and connected to the ground plane conductor 42 by a second via hole 41b. Disposed over the first hexagonally shaped conductive layer 46b is a corresponding layer of dielectric 46a here also comprised of silicon oxide, silicon nitride, or polyimide having a thickness selected to provide a predetermined capacitance as will also be described. Disposed over the dielectric layer 46a is the node metalization 44. Thus, forming the capacitor 46 to capacitively couple the node metalization to the ground plane conductor 42**.

Figure 4:
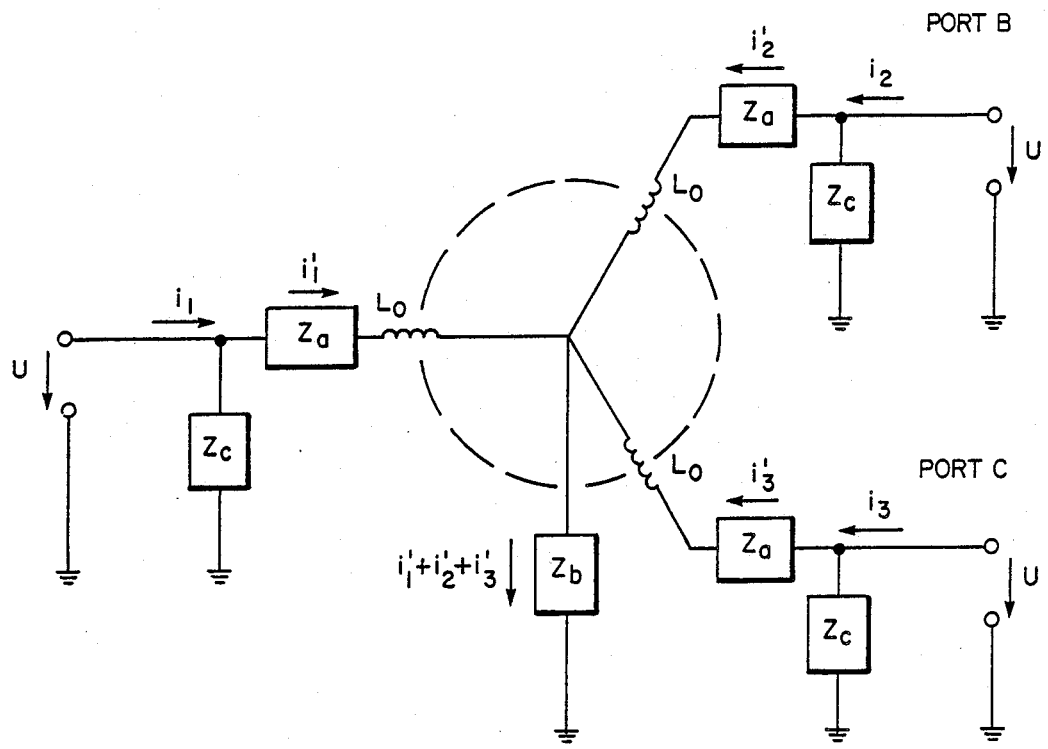
FIG. 4 is an equivalent circulator representation used to model the circulator of FIG. 2.

The broadband miniature circulator as described in conjunction with FIG. 2 may be analyzed on the basis of the equivalent circuit shown in FIG. 4. Here the effect of the ferrite disc is only symbolically indicated by the circle, but the relevant equations relating currents and voltages in various branches of the circuit are well known. The shunt impedance $Z_c$ and the node-to-ground impedance $Z_b$ are assumed to be capacitive. For simplicity, the series impedances $Z_a$ are replaced by short circuits in the present discussion, and it is assumed that without the ferrite disc the mutual inductances of the various branches of the coupling structure are negligibly small. The analysis includes optimization of the various device parameters to obtain broadband circulator performance at a given design frequency $f_o$. The mathematical procedure is as follows: First, the three eigenvalues of the scattering matrix are calculated on the basis of the circuit shown in FIG. 4. Then the conditions that the phases of these eigenvalues differ by 120° and that the derivative with respect to frequency is the same for each eigenvalue phase at the design frequency are imposed. These conditions are equivalent to four constraints and are sufficient to determine the following four circulator parameters:

1. normalized node-to-ground reactance $(1/(\omega_o C_b Z_o)$,
2. normalized shunt reactance $1/(\omega_o C_c Z_o)$,
3. normalized inductive coupling loop reactance $\omega_o L_o/Z_o$,
4. normalized resonant frequency of ferrite disc $f_H/f_o$.

here $\omega_o = 2\pi f_o$, $f_o$ is the design frequency, and $Z_o$ is the characteristic impedance of the transmission lines connected to the circulator.

Figure 5:
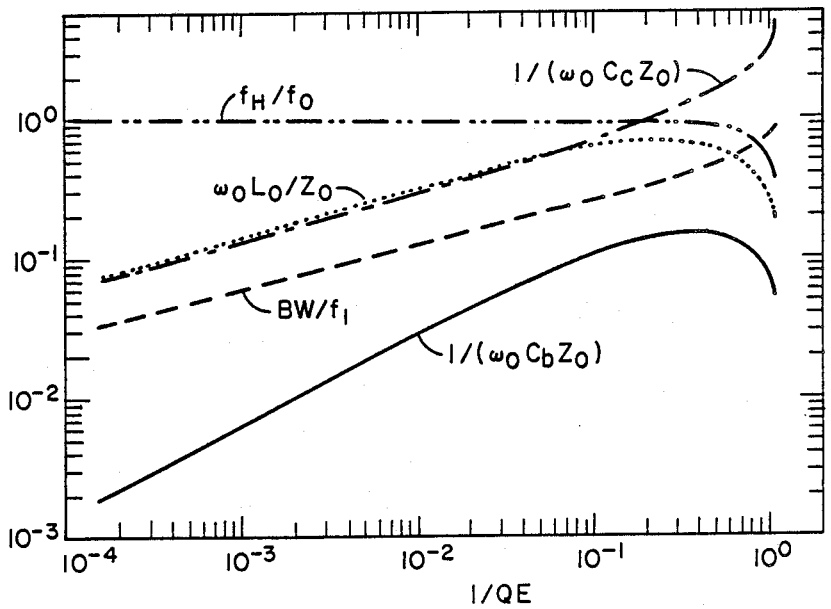
FIG. 5 is a plot of normalized bandwidth at 20 dB isolation versus inverse external quality factor (1/Qe) useful in selecting circulator parameters for optimum performance.
Figure 6:
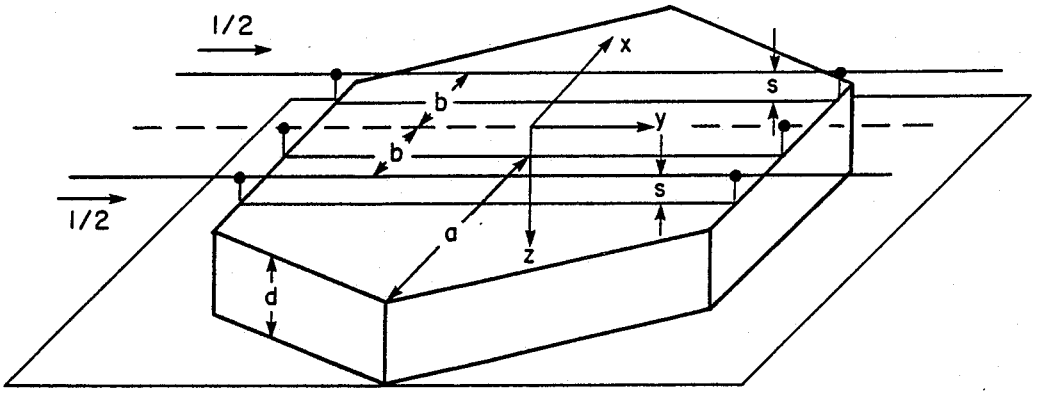
FIG. 6 is an isometric view of a ferrite disc having a hexagonal shape showing relevant geometric parameters useful in selecting circulator parameters for optimum performance.

FIG. 5 shows a summary of the calculations for the parameters listed above. Here the optimal device parameters are shown as a function of the inverse external quality factor $(1/Q_e)$ of the ferrite resonator disc. Inverse external Q is defined as $$1/Q_e = \mu_o 2\pi f_M V_f K^2/Z_o \quad (1)$$

where $\mu_o$ is the permeability of vacuum, $f_M$ the magnetization frequency, $V_f$ the volume of the ferrite disc and K a coupling factor that characterizes the ratio of magnetic fieldstrength (averaged over the volume of the resonator) to current. The external $Q_e$ is defined as the ratio of energy dissipated per cycle in an external load to the total stored energy. $1/Q_e$ is thus a measure of the tightness of the coupling between the ferrite and load.

FIG. 5 also shows the normalized bandwidth $BW/f_1$ as a function of $1/Q_e$ obtained by a separate calculation. Here the bandwidth at 20 dB isolation (BW) is normalized relative to the upper band boundary $f_1$. (This is preferable to normalizing relative to the design frequency $f_o$ because the design frequency may lie anywhere within the bandwidth BW.) The normalized bandwidth as defined here is necessarily less than unity. Octave bandwidth corresponds to $BW/f_1 = 0.5$, decade bandwidth to $BW/f_1 = 0.9$.

In order to express $1/Q_e$ in terms of the geometrical parameters of the circulator, the coupling factor K has to be calculated. In general, the microstrip line leading up to the circulator ports is branched into a plurality of strip conductors. In FIGS. 2A, 9A–16A, and 17, it is assumed that the microstrip line branches into two strip conductors, but a larger number of conductors, such as four or six, may be preferred. The calculation of the coupling factor K has been carried out, assuming that the microstrip line branches into two strip conductors, that the ferrite disc has hexagonal shape (disc radius = edgelength = a, thickness = d), and that it is located on a conductive plate of infinite conductivity (see FIG. 6). Here a "hexagon-shaped" ferrite substrate is used since integral circulator elements including interwoven coupling structures disposed on the ferrite substrate are relatively easy to fabricate compared to use of a circulator disc. The conductive strips at the top surface of the ferrite disc are approximated by line currents located at a given distance (s) from the ferrite surface and at a given spacing (b) from the center axis of the disc. The results can conveniently be expressed as $$1/Q_e = (1/Q_{eo})\,(Q_{eo}/Q_e) \quad (2)$$

$$1/Q_{eo} = \mu_o f_M a/Z_o \quad (3)$$

Thus, $1/Q_e$ is expressed as the product of two terms, one which is dependent only upon material parameters $(1/Q_{eo})$, the other $(Q_{eo}/Q_e)$ is dependent only upon geometric parameters of the ferrite disc having the hexagonal shape and $Q_{eo}/Q_e$ depends only on ratios of the geometrical parameters, i.e. on d/a, b/a, and s/a. It is convenient to express the disc "radius" a as a fraction $\alpha_1$ of the free space wavelength $\lambda_o = c_o/f_o$ where $c_o = (\mu_o \epsilon_o)^{-\frac{1}{2}}$ and the magnetization frequency $f_M$ as a fraction $\alpha_2$ of the design frequency $f_o$ $$a = \frac{\alpha 1}{f_o\,(\mu_o \epsilon_o)1/2} \quad (4)$$

$$f_M = \alpha_2 f_o.$$

Equation (3) can then alternatively be expressed as $$1/Q_{eo} = \frac{\alpha_1 \alpha_2 \sqrt{\mu_o/e_o}}{Z_o} \quad (5)$$

Since $\sqrt{\mu_o/\xi_o} = 377$ Ohm, one obtains for $1/Q_{eo}$ for $z_o = 50$ Ohm $$1/Q_{eo} = 7.54\xi_1\xi_2. \quad (6)$$

Figure 7:
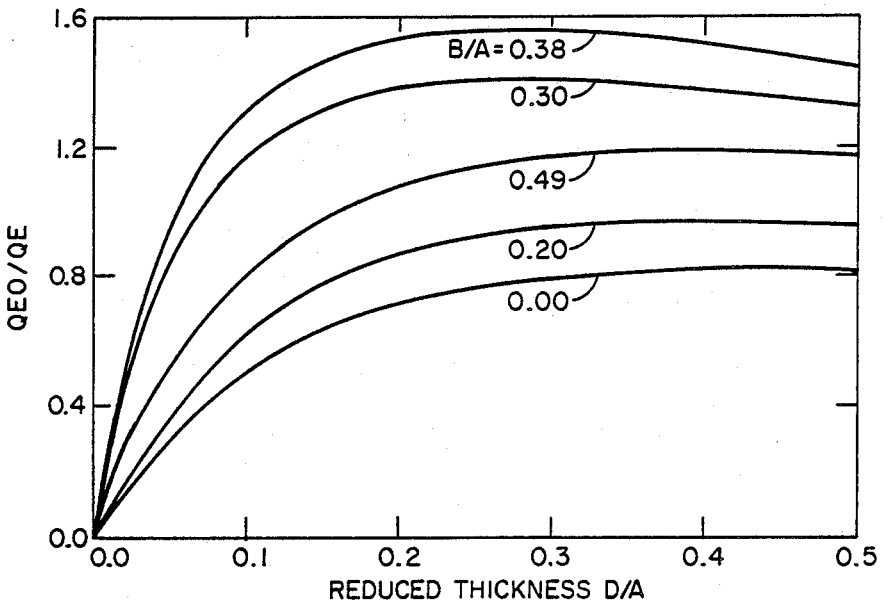
FIG. 7 is a plot of the inverse external Q expressed in terms of geometric parameters of the circulator versus reduced hexagonal shaped ferrite disc thickness for a circulator having split coupling lines in contact with the ferrite disc with reduced splitting (ratio of distance between split/strip conductors to the radius of the ferrite disc) as a parameter.
Figure 8:
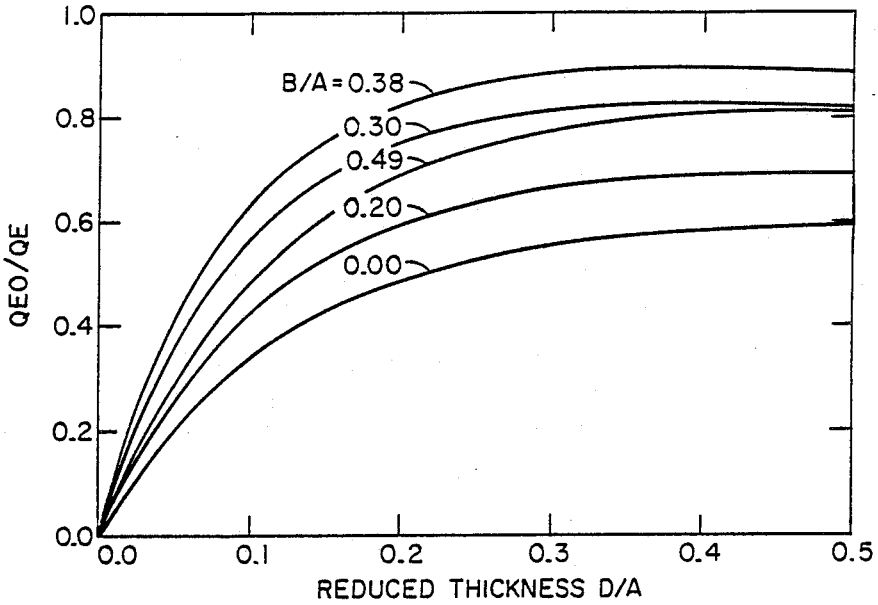
FIG. 8 is a plot of the inverse external Q expressed in terms of geometric parameters of the circulator as a function of reduced disc thickness for split coupling lines disposed at a finite distance from the ferrite surface with reduced splitting as a parameter.

FIGS. 7 and 8 show $Q_{eo}/Q_e$ versus reduced disc thickness d/a, with b/a as parameter, and assuming s = 0 (FIG. 7) or s/a = 0.1 (FIG. 8). The results show that, for given disc radius a, maximal bandwidth is obtained when the reduced disc thickness is near 0.25 and the reduced conductor splitting b/a is near 0.38. Spacing the conductive strips at a finite distance s from the ferrite surface diminishes $Q_{eo}/Q_e$, as may be expected. In the interwoven coupling structure shown in FIG. 2, the conductive strips are necessarily slightly spaced away from the ferrite surface over part of their length. Nevertheless, an effective reduced spacing s/a between 0.01 and 0.1 can probably be achieved. Thus the ratio $Q_{eo}/Q_e$ is near unity, and according to Eqs. (2) and (6) the inverse external quality factor under optimal conditions is:

$$1/Q_e \simeq 7.5\alpha_1\alpha_2 \quad (7)$$

The parameter $\alpha_2 = f_m/f_o$ can not be chosen arbitrarily. In order to avoid excessive loss at the lower edge of the circulator, bandwidth $\alpha_2$ can at most be of order unity. Taking $\alpha_2$ as equal to unity, one can use Eq. (7) in combination with FIG. 5 to estimate the disc radius required to achieve a given normalized bandwidth. Table 1 gives the results for 10% bandwidth, octave bandwidth and two-octave bandwidth.

TABLE 1

| Required Bandwidth | 10% | Octave | Two-Octave |
|---|---|---|---|
| $BW/f_1$ | .095 | 0.5 | 0.75 |
| $1/Q_e$ (from FIG. 3) | .004 | 0.55 | 0.95 |
| $\alpha_1 = a/\lambda_o$ (from Eq. (7), $\alpha_2 = 1$) | $5 \times 10^{-4}$ | 0.073 | 0.127 |

These results show that with the circulator design illustrated in FIG. 2, moderate bandwidth (approx. 10%) can be achieved for very small size in a MMIC-compatible configuration. For octave or two-octave bandwidth, the circulator size is necessarily somewhat larger, but still small compared to the wavelength.

A preferred technique for fabricating interwoven coupling structure having six interconnects through the dielectric 53 to interconnect upper and lower metalization layers will now be described in conjunction with FIGS. 9, 9A–9B, 12A–12B.

Figure 9:
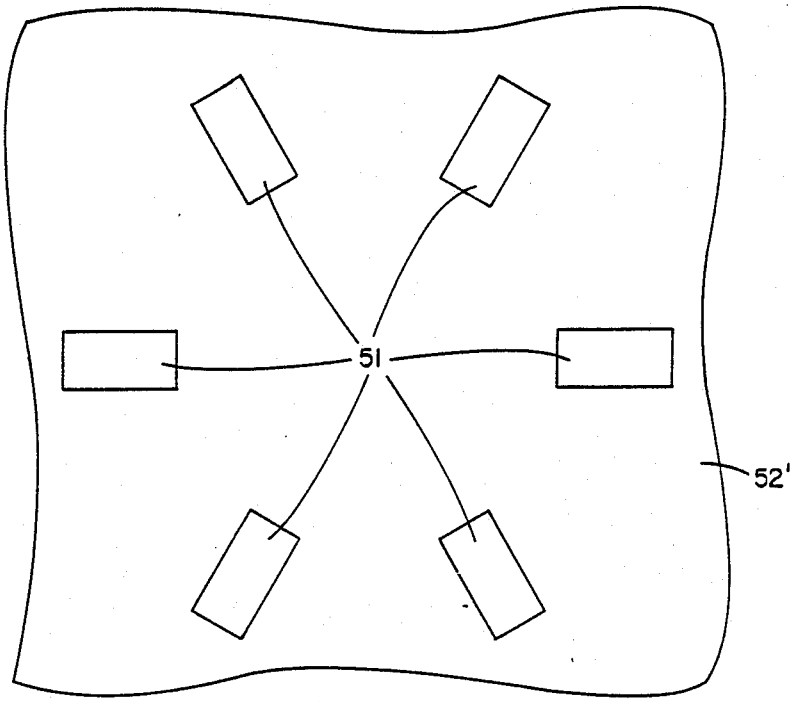
FIG. 9 is a plan view showing patches of masking material disposed over a substrate which is used to provide beam leads.

Referring first to FIG. 9, a substrate 52' here comprised of a ferrite although other substrate materials as will be described later may alternatively be used is shown to include a plurality of here six patches of photoresist 51 disposed about the periphery of a circle (not shown), as shown in FIG. 9. The photoresist patches 51 are used to fabricate beam leads for the interwoven coupling structures as also will be described.

Figure 9B:
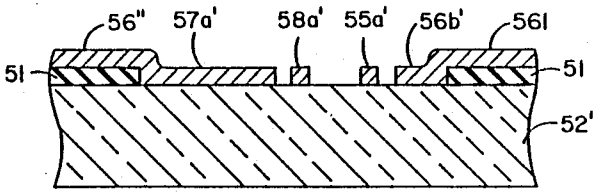
Figure 9A:
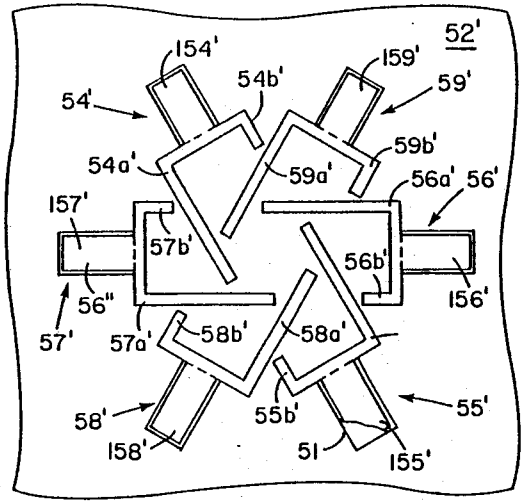

Referring now to FIGS. 9A and 9B, a first metalization layer for the interwoven coupling structure is shown to include a plurality of here six patterned strip conductors 54'–59' here with each patterned strip conductor segment including a first relatively wide strip conductor portion 154'–159' 159' disposed over corresponding photoresist patches 51 as shown for conductor 155'. Each strip conductor portion 54'–59' further includes a pair of branched portions **54*a*'–54*b*' through 59*a*'–59*b*' which have a common terminus at the corresponding wide strip conductor portions 154'–159' as also shown. Here the branched strip conductor portions 54*a*'–54*b*' through 59*a*'–59*b*' have a selected width and spacing to provide a selected impedance characteristic as described above. Each one of branched portions 54*a*'–59*a*' are relatively long branched portions whereas the branched portions 54*b*'–59' are relatively short branched portions. Generally, a composite conductive layer system is used. Thus, a thin layer of an adherent material such as titanium (not shown) is first deposited over the substrate 52'** followed by the conductive layers generally composed of gold.

Figure 10B:
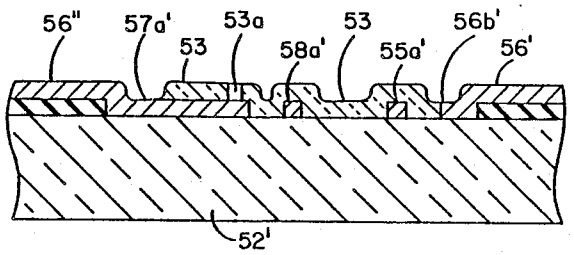
Figure 10A:
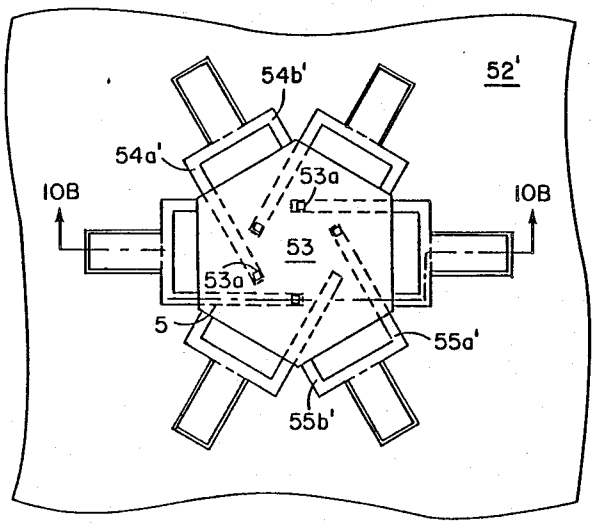

Referring now to FIGS. 10A, 10B a patterned layer of dielectric 53 is shown disposed over the plurality of strip conductor segments 54'–59' (FIG. 9A) as shown. Here the patterned layer of dielectric 53 is patterned to have a substantially hexagonal shape and is further patterned such that substantial major portions of the small strip conductor portions **54*b*'–59*b*' are exposed on the ferrite substrate 52' and terminated at the edge of the dielectric layer 53 as shown. Therefore, portions of the long strip conductors 54*a*'–59*a*' (FIG. 9A) are disposed under the dielectric layer 53. A plurality of apertures 53*a* here six of such apertures are opened up in the dielectric layer 53, with said apertures exposing underlying end portions of strip conductors 54*a*'–59*a*' (FIG. 9A) as shown. These apertures are used to make electrical interconnection between the first metalization layer and a second metalization layer as will be described in conjunction with FIG. 11A**.

Figure 11B:
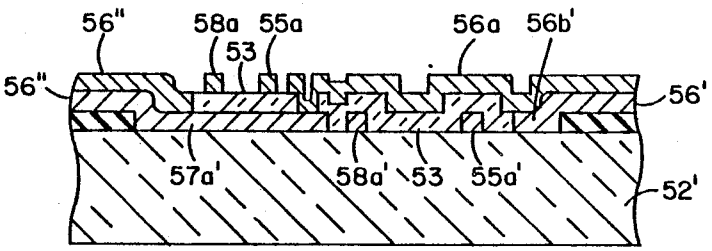
Figure 12B:
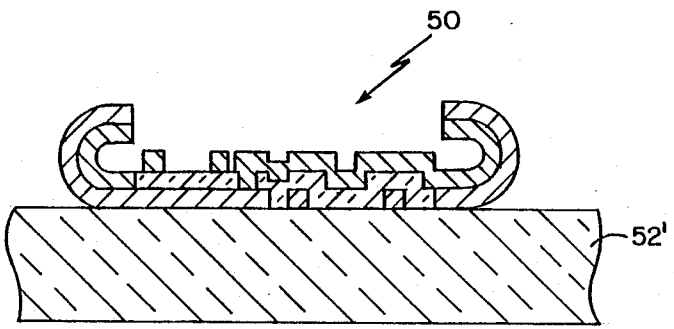
Figure 11A:
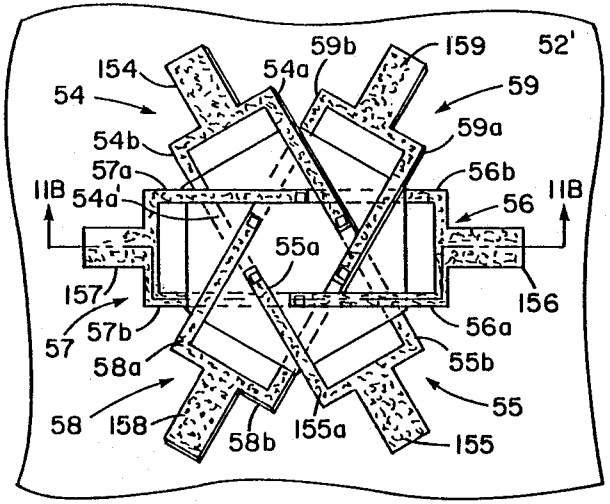

Referring now to FIGS. 11A, 11B a second layer of metalization is here shown disposed over the ferrite substrate 52' and dielectric layer 53. Here the second layer of metalization includes strip conductor segments 54–59, each having branched portions **54*a*–54*b*–59*a*–59*b* and wide portions 154–159 which are disposed over the corresponding underlying portions of the first metalization layer described in conjunction with FIG. 9A. Here the relatively long portions 54*a*–59*a* are disposed over the relatively short underlying portions 54*b*'–59*b*' of FIG. 9A; whereas the relatively short portion 54*b*–59*b* are disposed over the relatively long underlying portion 54*a*'--59*a*' (FIG. 9A). Thus, using conductor 56 as exemplary one of said conductors the relatively wide strip conductor portions 156–157 are disposed over the corresponding underlying portions 156'–157' with the relatively long branched portions 56*a* and 57*a* being spaced from the short underlying branched portions 56*b*'–57*b*' by the dielectric layer 53 and connected to the underlying long branched portions 56*a*'–57*a*' through the apertures 53*a* provided in the dielectric layer 53** as shown. Therefore, with this arrangement, an interwoven coupling structure having only six interconnects between the various layers is provided.

Figure 12A:
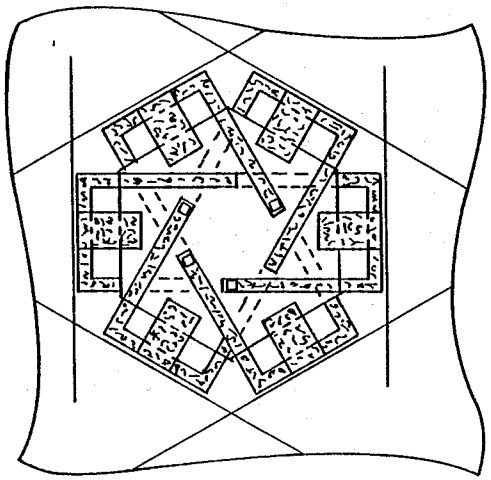
Figure 13:
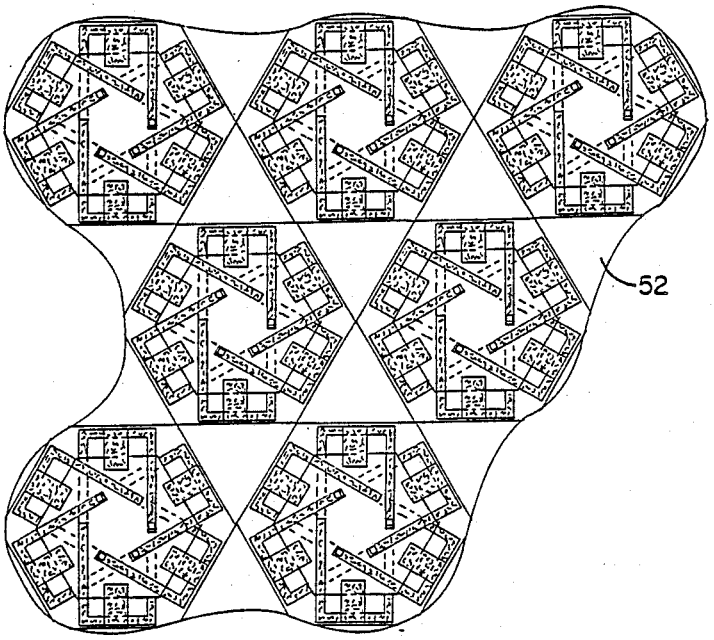
FIG. 13 is a plan view showing a plurality of coupling structures disposed on a common ferrite substrate which are cut into individual hexagonally shaped ferrite discs.

Referring now FIGS. 12 A and 12B, the photoresist patches 51 (FIG. 9) disposed under the beam leads 154–159 (FIG. 11A) are dissolved away using conventional techniques and the beam leads 154–159 are folded up and over the interwoven coupling structure. The ferrite substrate 52' is cut into a series of hexagonal discs 52 by a diamond saw as shown in FIG. 12A. A plurality of such interwoven coupling structures as shown in FIG. 13 may be fabricated by providing a plurality of such patterns over a relatively large ferrite. The photoresist patches may be eliminated by patterning the adherent layer in the shape of the hexagon and depositing gold over the central hexagon and beam leads. It is possible that the gold will not adhere to the ferrite and thus the beam leads will be provided without the photoresist patches 51.

Alternatively, the process of folding the beam leads up and over, which is required if the ferrite substrate is to be cut from the top side, can be completely avoided. To this end, a multiplicity of suitable alignment marks are generated on the back of the ferrite substrate, for instance by referencing them to a well defined right angle corner of the substrate. The substrate is then cut by means of a wafer cutting saw with accurately controlled depth of cut. This can be achieved without damaging the beam leads.

Referring now to FIGS. 14A, 14B through 16A, 16B, an alternate technique for fabricating the interwoven coupling structure here using patches of dielectric disposed to isolate upper and lower layers of metalization is shown.

Figure 14A:
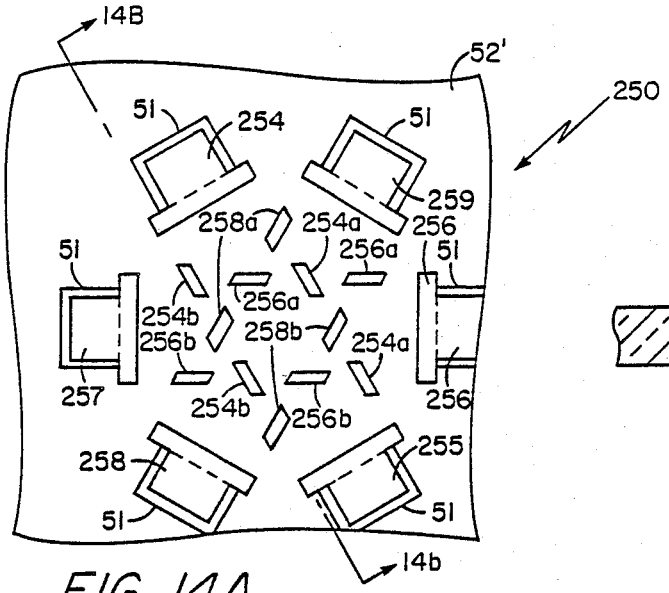
Figure 14B:
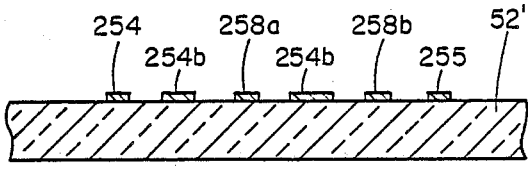

Referring first to FIG. 14A and 14B, ferrite substrate 52' is again here patterned with six patches 51 of photoresist as described in conjunction with FIG. 9 disposed generally about the periphery of a hexagon. Disposed over ferrite substrate 52' is a first layer of metalization including a plurality of here six patches 254–259 of metalization used to form the beam lead structure for the interwoven coupling structure, and a plurality of here parallelogram shaped patches of metal 254*a*, 254*b*, 256*a*, 256*b*, 258*a*, 258*b* disposed on the ferrite substrate 52' with the parallelogram shaped patches being used to form the interconnects for the upper layer of metalization as will be described in conjunction with FIG. 16A. Here the parallelogram patches are disposed between corresponding ones of pairs of the strip conductors such that patches referred to as 254*a* are disposed to provide interconnecting for the first strip conductor between the strip conductor portion 254 and 255 and patches 254*b* are spaced to provide interconnections with the second strip conductor between conductor 254, 255. Similarly, conductors 256, 257, and 258, 259 have corresponding similar patches of conductor 256*a*, 256*b* and 258*a*, 258*b* disposed to provide bottom layer interconnects.

Figure 15A:
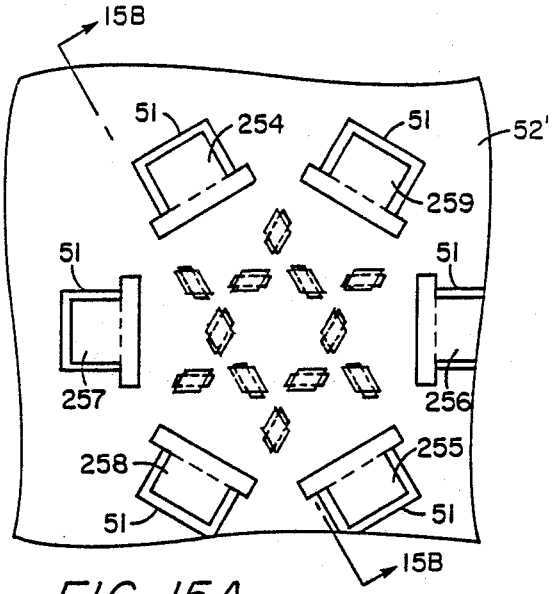
Figure 15B:
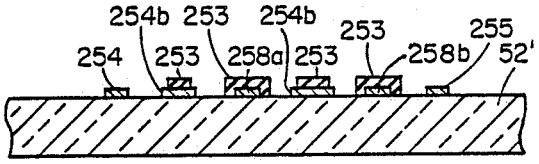

Referring now to FIGS. 15A–15B, patches of photoresist are shown disposed over the parallelogram shaped conductors exposing end portions along the length of the respective bottom conductor as shown.

Figure 16A:
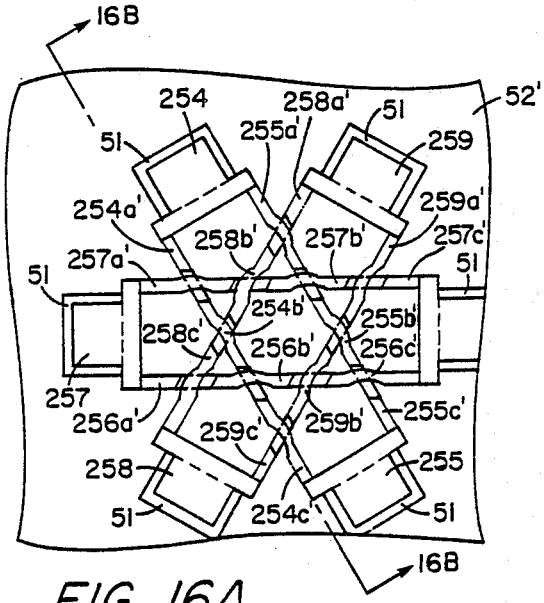
Figure 16B:
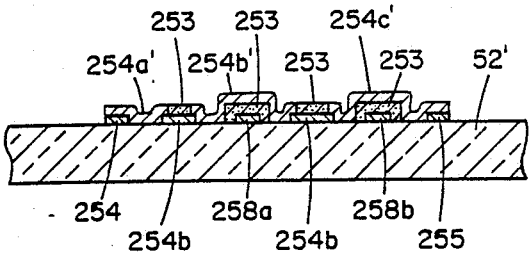

Referring now to FIGS. 16A–16B, a relatively long strip conductor portions here 254*a'*–254*c'* and 259*a'*–259*c'* are shown disposed over the dielectric patches 253 and bottom layer metalization patches described and referenced in FIG. 14A. For each one of the strip conductor patches 254–259, the relatively long strip conductors are interconnected at exposed ends to the bottom layer of metalization or are dielectrically spaced over the bottom layer of metalization depending on to which of the surfaces of the bottom metalization are exposed by the dielectric 253. Considering strip conductors 254–255, as an exemplary pair of such strip conductors, the upper layer of metalization includes strip conductor segments 254*a'* through 254*c'* and corresponding segments 255*a'*–255*c'*, with segments 254*a'* interconnected to segment 254*b'* through strip conductor pads 254*b* disposed on the bottom layer metalization as described in conjunction with FIG. 14A and isolated from upper metalization 257*a'* used to form strip conductor 257 by the dielectric layer 253 as shown. With this particular arrangement, small patches of dielectric may be used to provide the interwoven coupling structure thereby alleviating the need for providing a relatively large and uniformly thick layer of dielectric.

Figure 17:
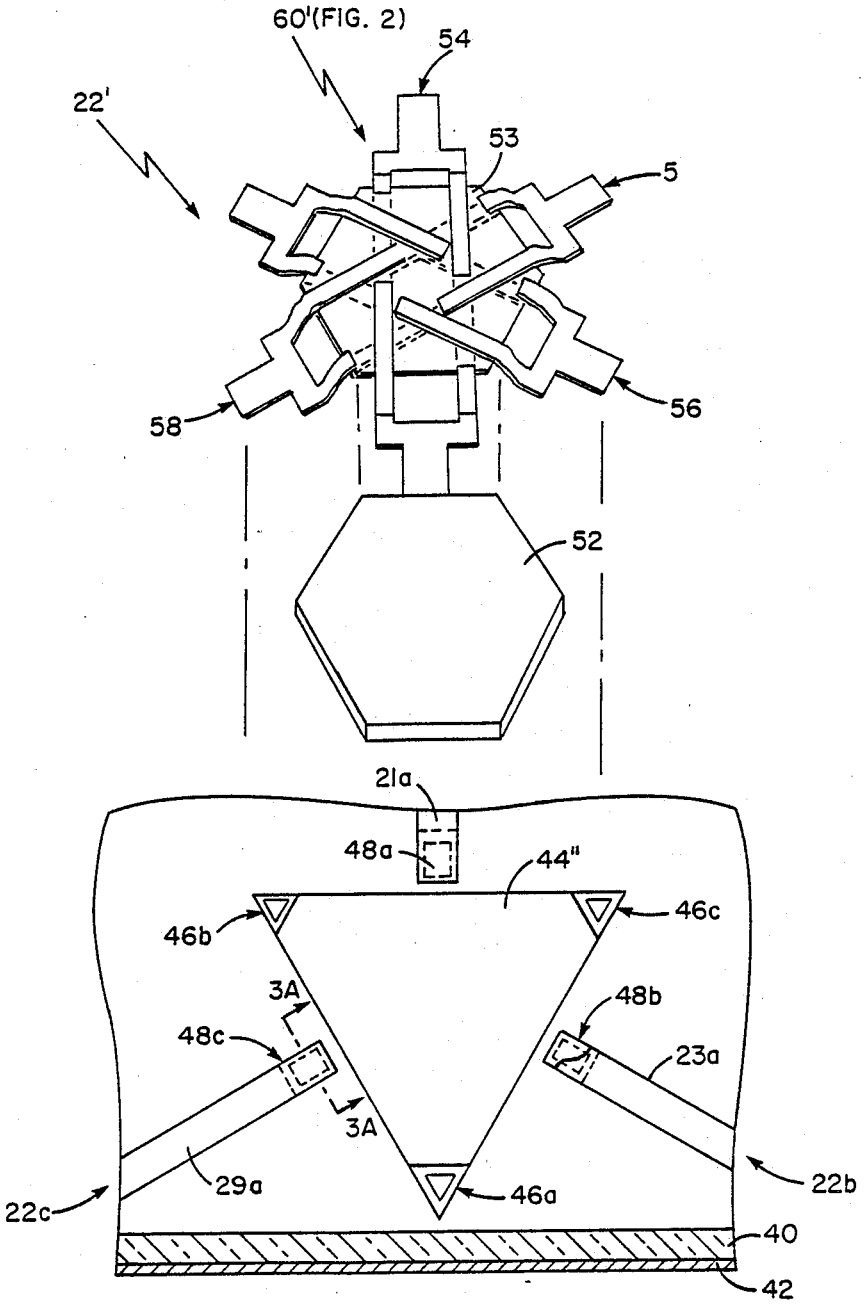
FIG. 17** is an exploded perspective view of an alternate embodiment of the circulator having peripheral node to ground capacitors and a separately fabricated coupling structure.

Referring now to FIG. 17, an alternate embodiment of the circulator 22' is here shown to include a free self-supported coupling structure 60' fabricated as generally described in conjunction with FIG. 2 and FIGS. 9–12A. Here, however, the coupling structure rather than being fabricated over a layer of ferrite is fabricated over a layer of material which is subsequently dissolved away. Materials such as MYLAR or acetate may be used as a temporary support for the interwoven coupling structure 60.

As also shown in FIG. 17, a hexagonally shaped ferrite disc 52 is disposed over the node metalization 44 provided on the substrate 40. Here the hexagonal shape ferrite is sawed from a substrate of ferrite materials as generally described in conjunction with FIG. 13. However, the hexagonal shape ferrite is sawed prior to the coupling structure being provided thereover, and thus the pattern for such hexagon-shaped member may be closely packed. The hexagon shaped ferrite 52 is then disposed on the node metalization 44'', and the coupling structure is disposed over the hexagonal shaped ferrite substrate 52 and is bonded by conductive epoxy or the like to the respective portions of the microstrip conductors 21*a*, 23*a*, and 29*a*, as well as, points along the node metalization 44'', as generally described in conjunction with FIG. 2. With this particular approach, the coupling structure is fabricated separately from the ferrite disc which may aid in the manufacturability of the process and which reduces the waste of expensive ferrites such as single crystal ferrites.

As also shown in FIG. 17, peripheral node to ground capacitors are disposed at the apexes of the triangular shape node metalization 44''. Here again node to ground capacitors 46*a*–46*c* are fabricated using similar techniques as described in conjunction with FIG. 2 except the capacitors 46*a*–46*c* are located at the tips of the triangular portion of the node metalization 44'' rather than at the central portion of the node metalization 44''. This particular arrangement allows the ferrite substrate 52 to be properly seated over the node metalization 44'' without a lump in the center of the node metalization which may result from the presence of a central node to ground capacitor 46 as shown in FIG. 2. Alternatively, in order to eliminate the presence of the lump in the node to ground metalization 44 (FIG. 2), a recess may be provided first on the upper surface of substrate 40. The integrated node to ground capacitor may then be fabricated in the recess portion of the substrate, thus insuring that the node to ground metalization is substantially flat over the surface over which is to be provided the ferrite substrate 52.

Having described preferred embodiments in the invention, it will now become apparent to one of skill in the art that other embodiments incorporating their concepts may be used. It is felt, therefore, that these embodiments should not be limited to disclosed embodiments, but rather should be limited only by the spirit and scope of the appended claims.

What is claimed is:

1. A radio frequency circulator, comprising:

a semiconductor substrate having a ground plane conductor disposed over a first surface thereof;

a patterned metal node layer disposed over a second opposite surface of said substrate;

a patch of dielectric disposed under a central, relatively small portion of said patterned node layer;

a layer of metal disposed on said substrate between said substrate and patch of dielectric;

a plated via disposed through said substrate to couple said metal layer to said ground plane conductor;

a disc comprised of a ferromagnetic material disposed on said patterned layer;

a coupling structure disposed over said disc including at least two strip conductors spaced by a dielectric with first ends of said strip conductors providing termini of the circulator and the second ends of said strip conductors disposed to be connected to said patterned metal layer disposed on the second surface of said substrate; and means for providing a D.C. magnetic field through said ferromagnetic disc.

2. The circulator of claim 1 further comprising a plurality of patterned strip conductors disposed on said second surface of said substrate disposed to be connected to said coupling structure and with said patterned strip conductors, substrate and ground plane conductors providing a microstrip transmission line medium.

3. The circulator of claim 2 wherein each strip conductor has a capacitor disposed thereunder to capacitively couple said strip conductor said ground plane conductor, each capacitor comprising:

a conductive layer disposed on said substrate;

a dielectric disposed on said conductive layer; and means for connecting said conductive layer to the ground plane conductor.

4. The circulator of claim 3 wherein said means for connecting to said ground plane conductor is a plated via hole.

5. The circulator of claim 4 wherein said substrate material is gallium arsenide.

6. The circulator of claim 4 wherein said ferrite material is selected from the group consisting of ferrites and garnets.

7. The circulator of claim 5 wherein said ferrite material is selected from the group consisting of lithium ferrite and yttrium iron garnet.

8. A microwave circulator which is compatible with monolithic microwave integrated circuits, comprising:

a semiconductor substrate having a ground plane conductor disposed over a first surface thereof;

a patterned metal layer disposed over a second, opposing surface of said substrate;

a disc comprised of a ferrite material disposed on said patterned metal layer, said disc having a hexagonal shape;

means including a first dielectric layer disposed over the second, opposite surface of said substrate for capacitively coupling a central portion of said patterned metal layer to said ground plane;

a coupling structure disposed over said disc comprising at least a pair of strip conductors spaced by a second dielectric layer; and means for providing a D.C. magnetic field through said ferrite disc.

9. The circulator of claim 8 wherein said capacitive coupling means includes a metal layer disposed on said substrate underlying a central portion of said patterned metal layer, spaced therefrom by said first dielectric, with said metal layer being connected to ground by a plated via hole disposed through said substrate.

10. The circulator of claim 9 further comprising a plurality of patterned strip conductors disposed on said second surface of said substrate disposed to be connected to said coupling structure and with said patterned strip conductors, substrate and ground plane conductors providing a microstrip transmission line medium.

11. The circulator of claim 8 wherein said coupling structure includes three patterned strip conductors each one having a pair of spaced strip conductor portions with a first one of said portion of a first conductor being interlaced with each strip conductor portions of the other one of said strip conductors.

12. The circulator of claim 11 further comprising a plurality of capacitors disposed to couple said strip conductors to said ground plane wherein each capacitor includes a metal layer disposed on said substrate, a dielectric layer disposed between said metal layer and said strip conductor and a plated via hole disposed through said substrate to couple said metal layer to the ground plane conductor.

13. A radio frequency circuit comprising:

a semiconductor substrate having a ground plane conductor disposed over a first surface thereof;

a patterned strip conductor layer disposed over a second, opposing surface of said substrate having a central ground node which is capacitively coupled to said ground plane conductor through said substrate;

a disc comprised of a ferromagnetic material having a substantially hexangular shape disposed over said patterned strip conductor;

a coupling structure disposed over said disc comprising a plurality of pairs of strip conductor segments with a strip conductor segment in each pair being connected between a pair of common termini with a first one of said termini being the ground node and a second one of said termini being a microstrip transmission line; and means for providing a D.C. magnetic field through said ferromagnetic disc.

14. The circulator of claim 13 wherein said capacitive coupling means includes a layer of dielectric disposed over the substrate and underlying a central portion of said patterned metal layer.

15. The circulator of claim 14 wherein said capacitive coupling means includes a plurality of patches of dielectric disposed over regions of said substrate underlying peripheral portions of said patterned metal layer.

* * * * *